US006665997B2

(12) United States Patent
Chen

(10) Patent No.: US 6,665,997 B2
(45) Date of Patent: Dec. 23, 2003

(54) EDGE INSERTS FOR STILES OF MOLDED DOORS

(76) Inventor: Kuei Yung Wang Chen, 201 Tung Hwa Road, Taipei (TW)

( * ) Notice: Subject to any disclaimer, the term of this patent is extended or adjusted under 35 U.S.C. 154(b) by 0 days.

(21) Appl. No.: 10/072,705

(22) Filed: Feb. 5, 2002

(65) Prior Publication Data

US 2003/0145542 A1 Aug. 7, 2003

(51) Int. Cl.[7] ..... E04C 2/38; E04C 2/54
(52) U.S. Cl. ..... 52/800.12; 52/784.15
(58) Field of Search ..... 52/800.11, 800.12, 52/800.13, 784.12, 784.13, 784.15, 455

(56) References Cited

U.S. PATENT DOCUMENTS 3,271,919 A * 9/1966 Olton ..... 52/717.01
3,364,645 A * 1/1968 Wenzelberger ..... 52/784.15
3,834,101 A * 9/1974 Wilder et al. ..... 428/122
4,152,876 A * 5/1979 Seely ..... 49/503
4,386,482 A * 6/1983 Quinif ..... 49/489.1
5,074,092 A * 12/1991 Norlander ..... 428/50
5,239,799 A * 8/1993 Bies et al. ..... 52/309.11

* cited by examiner

*Primary Examiner*—Carl D. Friedman
*Assistant Examiner*—Kevin McDermott
(74) *Attorney, Agent, or Firm*—Joseph L. Strabala

(57) ABSTRACT

In a synthetic door composed of two molded skins attached to a frame composed of stiles and rails of thin wooden strips to which the skins are adhered, with the core filled with a plastic foam, the improvement comprising a insert mechanically joined to each stile along their entire length, each insert having a channel device operable to interlock with its associated stile thereby providing the approximate strength of thicker wooden stiles conventionally used in constructing such doors, as well as providing finished vertical edges of the resulting door while significantly reducing the overall costs of such doors. In addition the insert can be employed to form an interlocking frame by extending the insert beyond the ends of the stiles and milling the ends of the rails so that they interlock with the channel means of the insert.

4 Claims, 4 Drawing Sheets

EDGE INSERTS FOR STILES OF MOLDED DOORS

BACKGROUND OF THE INVENTION

Field of the Invention

Synthetic doors are now common place as a replacement for the traditional wooden doors in residential and commercial buildings. Such synthetic doors are formed with resin sheets reinforced with fiber glass (in the art referred to as skins) attached to opposite sides of a rectangular frame with resulting cavity between the skins filled with a plastic foam. Doors so constructed do not warp, are not subject to insect infestation and are resistant to the elements. Moreover such doors can include wood graining on the outer surfaces of the skins, and also paneling formed in the skins, which gives these doors the appearance of natural wood fabricated products.

Molded skins for making doors of the type described are disclosed in U.S. Pat. No. 3,950,894 issued to DiMaio and in U.S. Pat. No. 4,550,540 issued to Thorn. These skins are typically formed using mixtures, having by weight 12% to 15% polyester resin, 5% to 15% polystyrene, 40% to 50% calcium carbonate and 15% to 25% chopped fiberglass. Such mixtures are layered in a compression molding machine and subjected to pressures from 600 to 1,500 psi for a cure cycle from 60 to 200 seconds to form rigid skins. The mixture described is one of those known as 'sheet molding compounds' [SMCs]. A general description of the sheet molding process is found in an article entitled "Compression Molding" by N. D. Simons in Modern Plastics Encyclopedia, Vol. 54 No. 0AS (1977–78).

Skins formed from SMC processes for doors can have thickness of from about 0.05 inches to about 0.20 inches, depending on the door application.

In the market place manufacturers of such doors face serious competition and any small decreases in the costs can often provided a manufacturer with a market advantage.

As previously noted such skins are affixed to opposite sides of a rectangular frame and core (cavity) enclosed by the frame and skins is filled with a plastic foam to complete the door, see for example the wooden frame in U.S. Patent Letters patent issued U.S. Pat. No. 4,550,540 issued to Thorn. A rigid urethane foam having a density of 0.8 pounds per cubic foot to 3.5 pounds per cubic foot is suitable for the core of such doors.

Wooden frames, the stiles and rails of the door, as shown in Thorn, are costly components. This invention relates to an edge insert incorporated into thin wooded stiles to increase the strength of the stiles and to stiffen them thereby improving both the door strength and the ease of fabrication while using thinner wooden stiles. In addition the insert provides finished vertical edges in the completed door without added costs This innovative edge insert is mechanically joined to the stiles to form a reinforced stile on both left side and right side of the molded door thereby providing an improved door. In addition the edge insert can be manufactured to deliver a host of edge configurations for the door such as wood graining, as well as providing a finished edge for any wooden element used the stiles.

An advantage is that the invention allows the smaller cross sectional configurations for the wooden stiles with out loss of strength or problems in production with an accompanying cost saving.

In the past formed extrusions have been employed as the stiles and rails of such doors, but it has been found that such extruded parts are too expensive to be competitive.

SUMMARY OF THE INVENTION

A synthetic door composed of two molded skins attached to a frame composed of thin wooden stiles and rails to which the skins are adhered, with the cavity between skins filled with a plastic foam wherein the stiles have a width of lesss than 1.5 inches the improvement comprising an insert mechanically joined to each stile along their entire length, each said inserts having a channel means operable to interlock with its associated stile and forming a finished outer edge on the stile. The insert is typically formed of a foamed polyvinyl chloride [PVC] extrusion.

In addition the insert can be employed to form an interlocking frame by extending the insert beyond the ends of the stiles and milling the ends of the rails so that they interlock with the channel means of the insert.

BRIEF DESCRIPTION OF THE DRAWING FIGURES

DETAILED DESCRIPTION OF THE PREFERRED EMBODIMENTS

Figure 1:
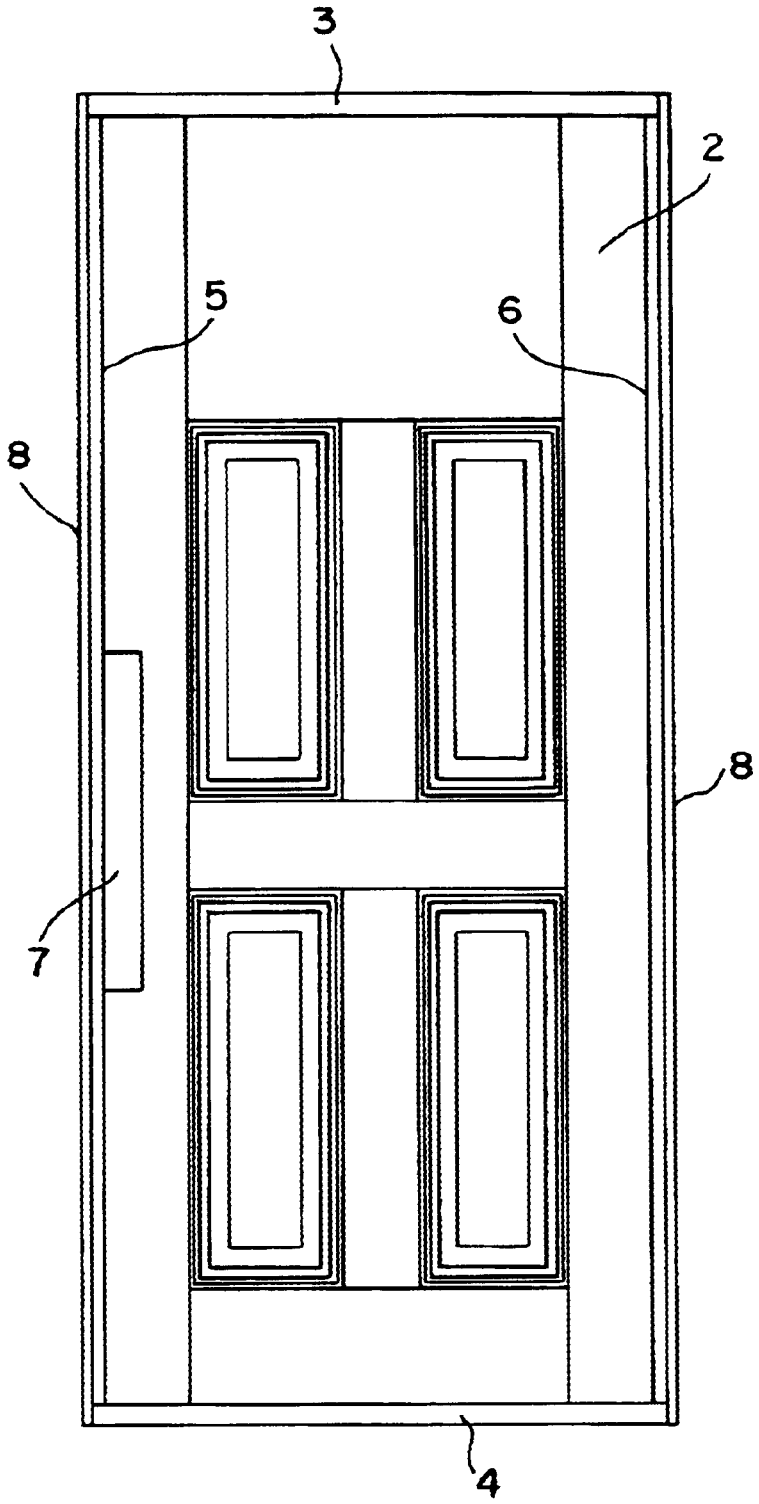
FIG. 1 is a plan view of a molded door using the insert of the invention with the top skin removed to show the internal details of the door.

In FIG. 1 the molded door structure of the invention is illustrated. It has seven basic members, including two molded door skins 1, 2 (front skin 1 not shown in FIG. 1 being removed to show the interior components), a rectangular frame composed of thin wooden strips which form the top rail 3, the bottom rail 4, a left stile 5 and a right stile 6 along with a hardware reinforcing block 7. This block increases the strength of the door where the door latching hardware is installed. The door skins 1 and 2 are affixed the top rail 3, the bottom rail 4, the left stile 5, and the right stile 6 using one of the adhesives well known in the art; there after internal core (or cavity) 9 is filled up with polyurethane foam, or the like, to form the molded door. Such doors are generally water proof and resistant to corrosion.

In the prior art the wooden elements used for the rails 3 and 4 and the stiles 5 and 6, were approximately 3 or 4 inches in width [76 to 101 mm] and 1.59 inches [40.4 mm] in thickness. According to this invention dimensions of these wooden elements can be reduced to widths varying from 0.78 inches to 1.18 inches [20 mm to 30 mm] with a thickness of 1.59 inches [40.4 mm]. The thickness of the thinner stiles is roughly the same as conventional stiles since doors come in standard widths. This difference in size of the wooden elements used for the stiles in this invention greatly reduces the costs of such molded doors. However, these thinner elements are not as stiff as the wider wooden elements used in the past and difficulty is often experienced in maintaining the proper position of the thinner stiles during door construction when the skins are applied to a frame composed of such elements. In addition the thinner elements have much less strength. Further, in the prior art the raw edges of the wider wooden stiles are exposed when the door is completed and must be finished to match the texture of the skins employed on the surfaces of the completed door.

Figure 2:
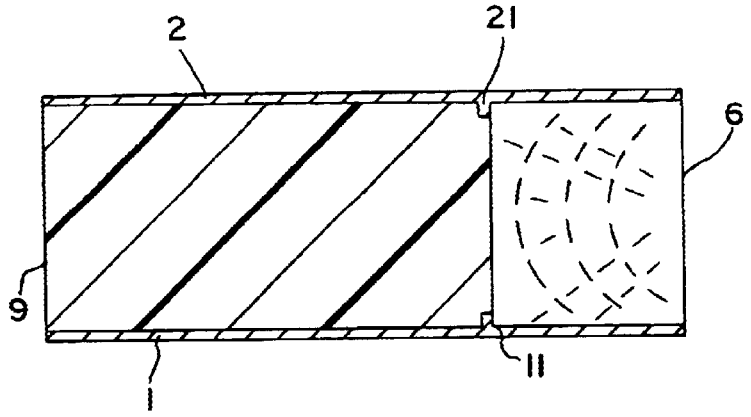
FIG. 2 PRIOR ART
FIG. 2 is a cross-section, with parts broken away, of a prior art molded door using projecting ribs from the skins that support the stiles to increase the structural strength of the molded door.

For example, in FIG. 2 showing a prior art molded door employing ribs 11 and 21 to maintain the stile 6 in place and to strengthen the overall door structure. With this type of structure is that it is very difficult to get the stile in proper position so that the rib abuts on the stile to reinforce it especially if has a width of less than one inch [24.5 mm] and the raw edge of the stile is exposed in the finished door.

Figure 3:
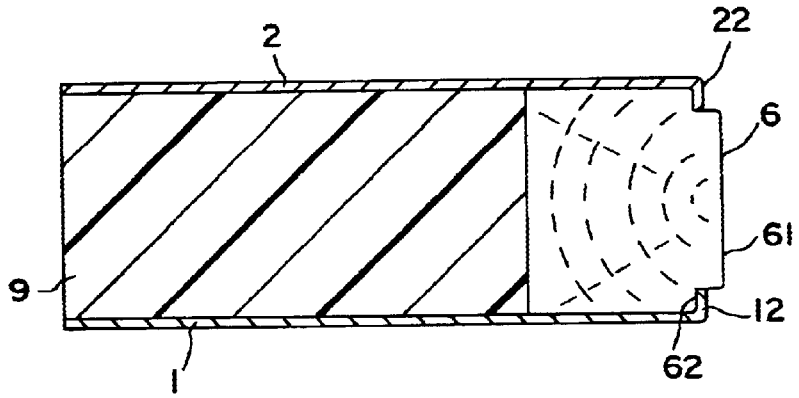
FIG. 3 PRIOR ART
FIG. 3 is a cross-section, with parts broken away, of another prior molded door wherein the edges of the skins are molded with L-shaped flanges to engage the stiles to increase the structural strength of the molded door.

Positioning the stile 6 is less of a problem in the prior art configuration shown in FIG. 3 wherein the skins 1 and 2 are molded with L-shaped flanges 12 and 22 at their peripheral edges that are received in edge recesses formed in the stile 6 to help stabilize the stile during the assembly. In this structure the corners of the stile illustrated are milled to form a shoulder 62 which leaves an exposed extension 61 of the stile with a raw surface. These shoulders cooperate with the L-shaped flanges 12, 22 which abut on the shoulders to assist in positioning the stile during assembly. In all the forgoing doors the raw edges of the stiles are exposed.

Figure 4:
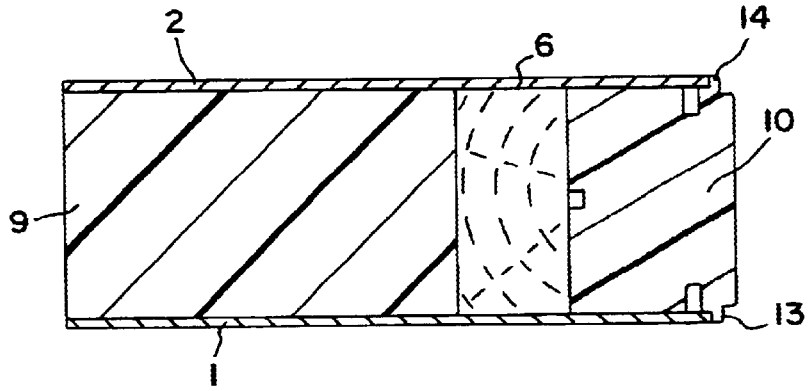
FIG. 4 PRIOR ART
FIG. 4 is a cross-section, with parts broken away, of a prior molded door developed by the applicant, wherein the edges of the skins abut on the ribs extending from the stiles to strengthen the door.

In the molded door shown as FIG. 4, developed by the applicant the wooden stile 6 includes a separate plug element 10 which abuts against the stile and forms a plug around the edges of the door. This plug element is formed of a foamed extrusion and together with the wooden stile provide increased strength in the door. In this door the plug includes two longitudinal ribs 13 and 14 which are formed on the plug so that the edges of the skins abut against these ribs for strengthening the door. Such plug elements, while providing finished edges on the doors in which they are used, measurably increase the costs of the doors both as to materials and assembly.

The edge insert of the invention has the advantage of increasing the molded door strength when using thinner wooden stiles and thereby lowering the costs. It also provides a finished vertical surface at the edges of the door and can be matched to the texture of the molded door skins.

Figure 5:
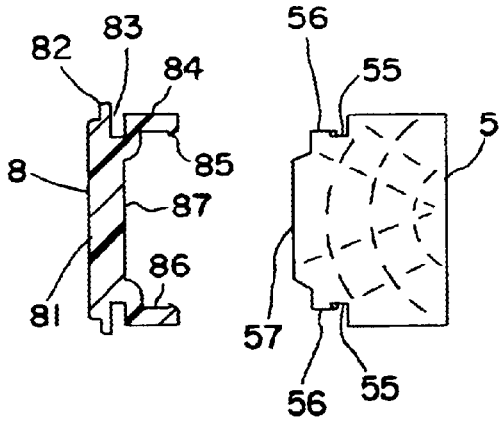
FIG. 5 is a cross-sectional of edge insert along with its mating stile illustrating how the insert is joined to its stile.

Referring to FIG. 5, where the edge insert 8 is shown in cross section, it is formed like a cap for the stiles having a body 81 with two perpendicular legs 84 and 86 so that the inner side of the insert forms a hollow u-shaped channel 87. The body of the insert has a thickness of 0.27 inches to 0.47 inches [7 mm to 12 mm] and a width matching the thickness of wooden stile used, i.e., approximately 1.59 inches [40.4 mm].

The outer face 81 of the insert 8 terminates in extending ribs 82 which are designed to abut against the edges of the skins when a stile 5 or 6 includes the insert assembled thereon. Opposite the face is the u-shape channel 87 and on the distal ends of the leg are inwardly directed flanges 85 that will lock these members in the channels formed in the stile when received therein. If desired the insert can include a positioning groove 83 adjacent to the ribs 82 so that door skins with an L-shaped flanges along their edges will be compatible with the insert.

The generally square left stile 5 and the right stile 6 need to be milled to the profile of the u-shaped channel 87 of the insert 8 so that the insert interlocks with its stiles when slid onto the stile. It has been found that once the insert is assembled on the stiles the resulting strength of this composite matches the strength of wooden stiles having a width from 3 inches to 4 inches [76 to 101 mm]. This configuration is shown in FIG. 5 illustrating that the stiles have a nose 57 matching the configuration of the u-shaped channel which has two shoulders 56 and two grooves 55 which receive the inwardly directed flanges 85 of the insert when it is slid onto the stile, locking the insert securely to the stile. This mechanical interlocking enables easier assembly and less waste of materials. If desired the inserts can be glued onto the stiles. The insert stabilizes the wooden stile and provides it with a finished edge.

Referring again to FIG. 7 and FIG. 8, when the edge insert 8 of the invention is fitted to the left stile 5 or the right stile 6, the noses 57 of the left stile 5 or the right stile 6 fits snugly into the u-shaped groove 87 of the insert with inwardly directed flanges 85 of the insert engaging its grooves 55 in the stiles mechanically locking the inserts on the stiles. Other interlocking arrangements wherein the mechanical strength of the insert can be imparted to the wooden stile are within the contemplation of this invention.

Figure 7:
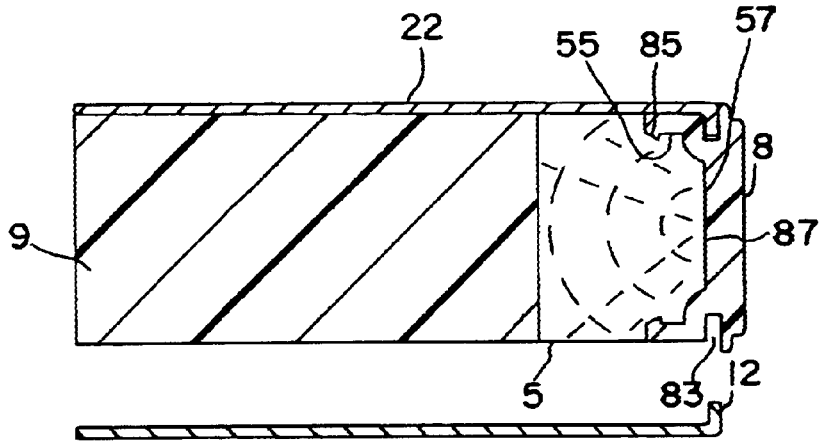
FIG. 7 is an exploded cross-section, with parts broken away, of the invention illustrating that the edge insert is compatible with skins which are molded with L-shaped flanges at their edges.

If the insert is equipped with positioning grooves 83, it can be used with molded door skins with a L-shaped flanges 12 and 22 formed at side ends as shown in FIG. 7. This structure forms a very stable door product due to a direct skin interlock with in the insert.

Figure 8:
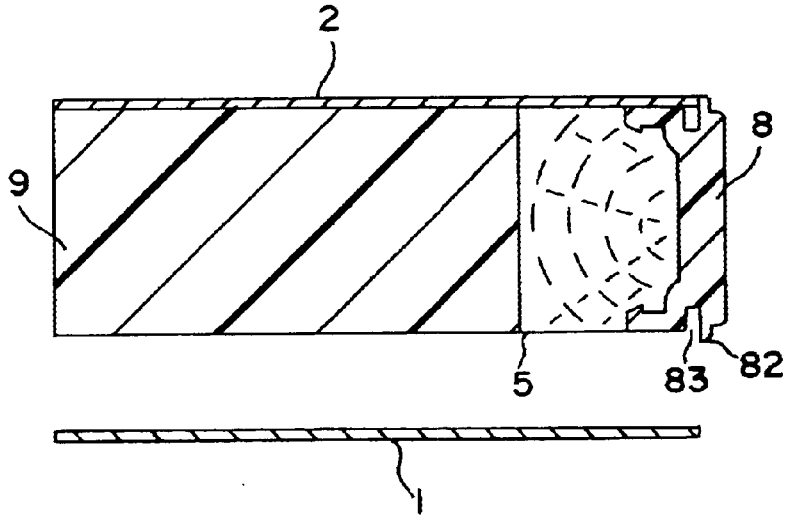
FIG. 8 is an exploded cross-section of the novel door, with parts broken away, illustrating how the edge insert interacts with conventionally molded skins to increase the strength of the door.

Referring to FIG. 8, it can be seen that the insert 8 of the invention can also be used with flushed molded door skins. In this embodiment the ribs 82 of the insert form abutting surfaces for the edges of the skins adding both strength and enabling more precise alignment of the skins with the stiles during door assembly.

Figure 6:
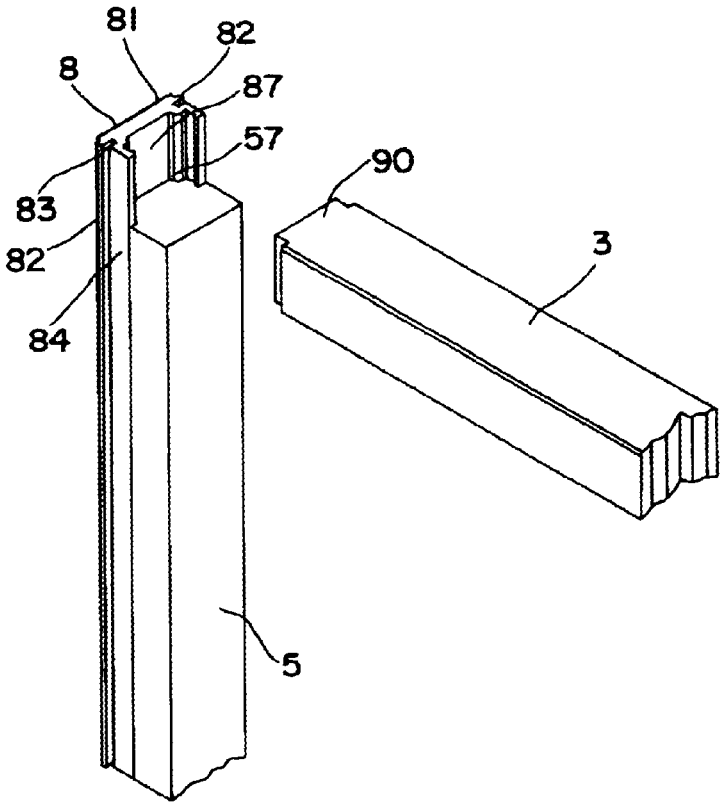
FIG. 6 is a perspective view of the edge insert assembled with its stile and rail, with parts broken away, illustrating how the rails are assembled with the stiles in an interlocking relationship when the door is being assembled.

Another feature of the insert 8 of the invention is that it can be used as a interlock to hold the rails in place at the top and bottom of the door. As can be seen in FIG. 6 the ends 90 of the rails at the top and bottom of the frame are milled to the same configuration as the nose of the stiles described above and the inserts are extended beyond the top and bottom ends as shown. With this arrangement the rails, which are much shorter than the stiles, can be interlocked with the stiles through the edge insert assisting in the construction of the novel door and improving its resulting strength.

The inserts are manufactured of polyvinyl chloride [PVC] extrusions which are known in the art.

Applicant has found that cost reductions can be obtained using this invention, without any sacrifice of door integrity or performance.

Having described my invention I claim:

What is claimed is:

1. In a synthetic door composed of two molded skins attached to a frame of wood stiles and rails to which the skins are adhered and having a core filled with a plastic foam wherein the stiles have a width of less than 1.5 inches, the improvement comprising an edge insert mechanically joined to each stile along the entire length of the stile and extending beyond the ends of said stiles, each of said inserts having a channel means operable to interlock with the stile to strengthen said stile and to form an exterior finished edge on the stile and said rails having respective ends milled so that said ends interlock with said channel means at said ends of said stiles when said frame for said door is assembled to form an interlocked rectangular frame prior to gluing of the skins to said frame, each edge insert having a u-shape with legs which form a cap on the stile and which legs are glued to the underside of said skins when said skins are glued to the exposed wooden portions of the stile.

2. The synthetic door as defined in claim 1 wherein each edge insert is glued to the stile and the milled ends of the rails are glued in the channel means of each insert at the ends of said stiles.

3. The synthetic door as defined in claim 1 wherein each edge insert is injection molded and the stile is milled to a configuration which fits into the channel in the edge insert.

4. The synthetic door as defined in claim 1 wherein each edge insert is injection molded of polyvinyl chloride.

* * * * *